US011950747B2

(12) United States Patent
Miller et al.

(10) Patent No.: US 11,950,747 B2
(45) **Date of Patent: *Apr. 9, 2024**

(54) EXTRACTION CLEANER AND CLEANOUT TOOL FOR THE SAME

(71) Applicant: BISSELL Inc., Grand Rapids, MI (US)

(72) Inventors: David M. Miller, Zeeland, MI (US); Karyn Lee Sagorski, Grand Rapids, MI (US); Daniel Browne, St. Bernard, OH (US)

(73) Assignee: BISSELL Inc., Grand Rapids, MI (US)

( * ) Notice: Subject to any disclaimer, the term of this patent is extended or adjusted under 35 U.S.C. 154(b) by 217 days.

This patent is subject to a terminal disclaimer.

(21) Appl. No.: 17/179,680

(22) Filed: Feb. 19, 2021

(65) Prior Publication Data

US 2021/0169285 A1 Jun. 10, 2021

Related U.S. Application Data

(63) Continuation of application No. 16/183,165, filed on Nov. 7, 2018, now Pat. No. 10,952,577, which is a (Continued)

(51) Int. Cl.
*A47L 9/00* (2006.01)
*A46B 5/00* (2006.01)
(Continued)

(52) U.S. Cl.
CPC ..... *A47L 9/00* (2013.01); *A47L 9/02* (2013.01); *A47L 11/34* (2013.01); *A47L 11/40* (2013.01); *A47L 11/4044* (2013.01); *A46B 5/0016* (2013.01); *A46B 15/0055* (2013.01); *A46B 15/0075* (2013.01); *A47L 9/0018* (2013.01)

(58) Field of Classification Search
CPC ... A47L 9/00; A47L 9/02; A47L 11/34; A47L 11/40; A47L 11/4044; A47L 9/0018; A46B 5/0016; A46B 15/0055; A46B 15/0075
See application file for complete search history.

(56) References Cited

U.S. PATENT DOCUMENTS 1,381,973 A * 6/1921 Davis ..... A47L 11/4013 15/104.001
1,600,388 A * 9/1926 William ..... A46B 17/06 15/186
(Continued)

FOREIGN PATENT DOCUMENTS

CN 203457974 U 3/2014
CN 204070984 U 1/2015
(Continued)

OTHER PUBLICATIONS

The Hoover Company, "Hoover SteamVac The Easy to Use Deep Cleaner Owner's Manual", 12 pages, 1993.
(Continued)

*Primary Examiner* — David Redding
(74) *Attorney, Agent, or Firm* — Quinn IP Law

(57) ABSTRACT

An extraction cleaner having a cleanout tool for use with a surface cleaning apparatus such as an extraction cleaner or vacuum cleaner includes a nozzle cleaning implement and a brush cleaning implement.

17 Claims, 8 Drawing Sheets

Related U.S. Application Data continuation of application No. 15/072,828, filed on Mar. 17, 2016, now Pat. No. 10,165,917.

(60) Provisional application No. 62/134,061, filed on Mar. 17, 2015.

(51) Int. Cl.

| | |
|---|---|
| ***A46B 15/00*** | (2006.01) |
| ***A47L 9/02*** | (2006.01) |
| ***A47L 11/34*** | (2006.01) |
| ***A47L 11/40*** | (2006.01) |

(56) References Cited

U.S. PATENT DOCUMENTS

| | | | | |
|---|---|---|---|---|
| 2,564,721 | A * | 8/1951 | Julian | A45D 24/46 15/236.08 |
| 3,792,707 | A | 2/1974 | Tupper | |
| 6,134,744 | A * | 10/2000 | Kasen | A47L 11/03 15/328 |
| 6,842,942 | B2 * | 1/2005 | Morgan | A47L 5/28 15/322 |
| 10,952,577 | B2 * | 3/2021 | Miller | A47L 11/40 |
| 2003/0024067 | A1 * | 2/2003 | Roney | A47L 9/0009 15/323 |
| 2003/0226228 | A1 * | 12/2003 | Symensma | A47L 11/34 15/353 |
| 2004/0088817 | A1 * | 5/2004 | Cochran | A47L 7/0042 15/327.5 |
| 2008/0092325 | A1 * | 4/2008 | Vander Baan | A47L 11/4002 15/328 |
| 2008/0230083 | A1 | 9/2008 | Williams | |

FOREIGN PATENT DOCUMENTS

| | | | |
|---|---|---|---|
| CN | 204744006 | U | 11/2015 |
| WO | 201511898 | A1 | 8/2015 |

OTHER PUBLICATIONS

David J. Evans, Patents Act 1977: Search Report Under Section 17(5), Sep. 15, 2016, 4 pages, Intellectual Property Office, South Wales.

* cited by examiner

EXTRACTION CLEANER AND CLEANOUT TOOL FOR THE SAME

CROSS REFERENCE TO RELATED APPLICATION(S)

This application is a continuation of U.S. patent application Ser. No. 16/183,165, filed Nov. 7, 2018, now allowed, which is a continuation of U.S. patent application Ser. No. 15/072,828, filed Mar. 17, 2016, now U.S. Pat. No. 10,165,197, issued Jan. 1, 2019, which claims the benefit of U.S. Provisional Patent Application No. 62/134,061, filed Mar. 17, 2015, all of which are incorporated herein by reference in their entirety.

BACKGROUND

Extraction cleaners are well-known surface cleaning apparatuses for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other surface cleaning apparatuses include vacuum cleaners, which can have a nozzle adjacent the surface to be cleaned in fluid communication with a collection system and an agitator can be provided for agitating the cleaning fluid on the surface.

BRIEF DESCRIPTION

An aspect of the present disclosure relates to a surface cleaning apparatus, including a fluid delivery system, comprising at least one fluid container for storing a supply of fluid, and a fluid distributor in fluid communication with the at least one fluid container for delivering fluid to the surface to be cleaned, a recovery system, comprising a suction nozzle assembly defining a suction pathway, a suction source in fluid communication with the suction nozzle for generating a working air stream; and a recovery container for collecting fluid and debris from the working air stream for later disposal, an agitator provided adjacent to the suction nozzle for agitating the surface to be cleaned, and a tool mount

BRIEF DESCRIPTION OF THE DRAWINGS

The invention will now be described with respect to the drawings in which.

DETAILED DESCRIPTION

Aspects of the present disclosure relate to a cleanout tool for a surface cleaning apparatus such as an extraction cleaner that delivers cleaning fluid to a surface to be cleaned and extracts spent cleaning fluid and debris (which may include dirt, dust, stains, soil, hair, and other debris) from the surface. In one of its aspects, the invention relates to a cleanout tool configured to remove hair, fuzz, carpet fibers or any other material that may become clogged within the suction nozzle or stuck/intertwined on the agitator of the extraction cleaner. The cleanout tool may also be used to clean the suction nozzle or agitator of a vacuum cleaner.

Figure 1:
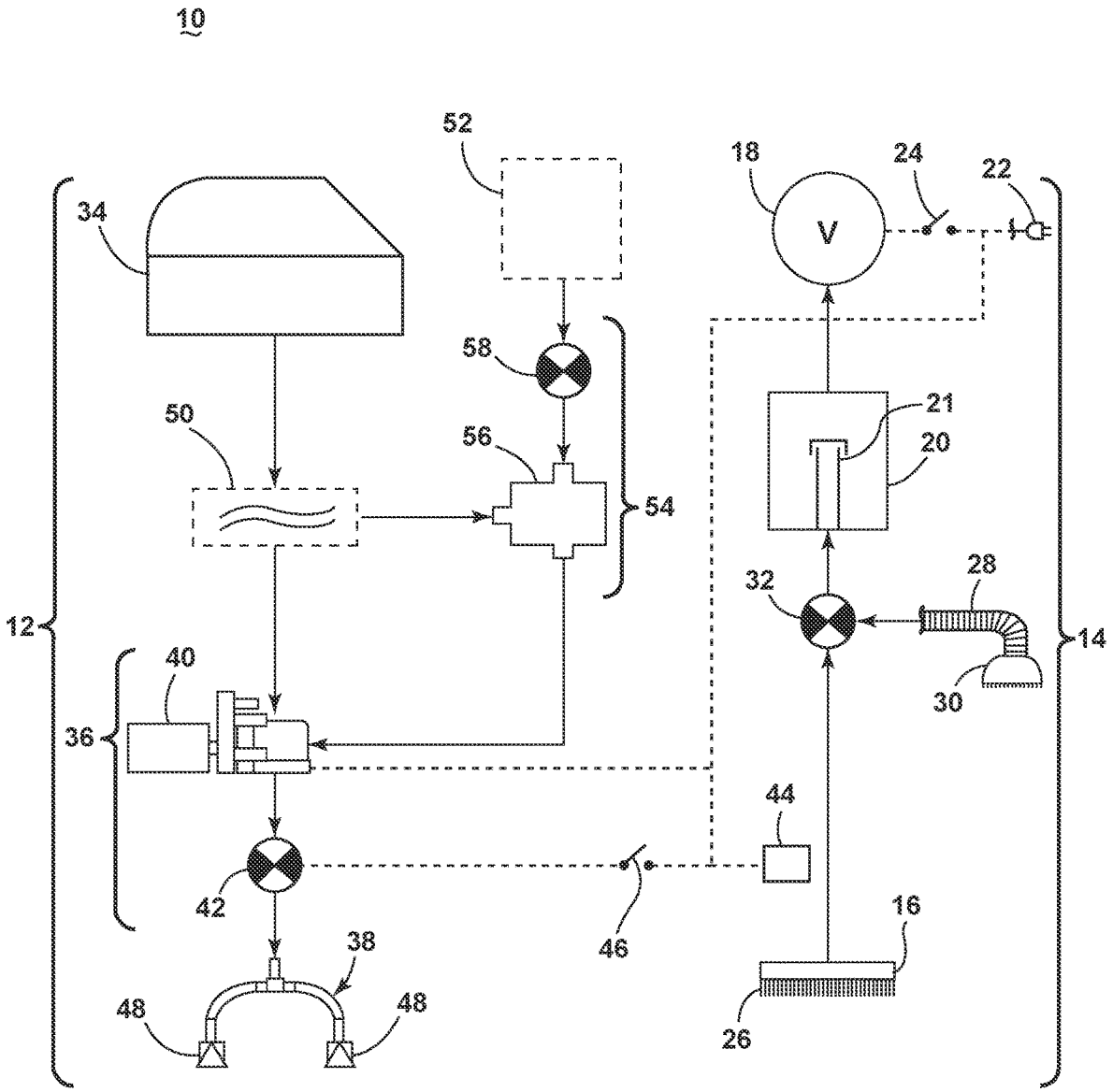
FIG. 1 is a schematic view of an extraction cleaner.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working air stream, and a recovery container 20 for separating and collecting fluid and debris from the working airstream for later disposal. A separator 21 can be formed in a portion of the recovery container 20 for separating fluid and entrained debris from the working airstream.

The suction source 18, such as a motor/fan assembly, is provided in fluid communication with the recovery container 20. The suction source 18 can be electrically coupled to a power source 22, such as a battery or by a power cord plugged into a household electrical outlet. A suction power switch 24 between the suction source 18 and the power source 22 can be selectively closed by the user, thereby activating the suction source 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the suction source 18 for above-the-floor cleaning using an above-the floor cleaning tool 30 with its own suction inlet. A diverter assembly 32 can be selectively switched between on-the-floor and above-the floor cleaning by diverting fluid communication between either the suction nozzle 16 or the vacuum hose 28 with the suction source 18.

The fluid delivery system 12 can include at least one fluid container 34 for storing a supply of fluid. The fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The fluid delivery system 12 can further comprise a flow control system 36 for controlling the flow of fluid from the container 34 to a fluid distributor 38. In one configuration, the flow control system 36 can comprise a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26. The at least one distributor outlet 48 can comprise any structure, such as a nozzle or spray tip; multiple outlets 48 can also be provided. As illustrated in FIG. 1, the distributor 38 can comprise two spray tips 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the suction source 18.

As another option, the fluid delivery system can be provided with an additional container 52 for storing a cleaning fluid. For example, the first container 34 can store water and the second container 52 can store a cleaning agent such as detergent. The containers 34, 52 can, for example, be defined by a supply tank and/or a collapsible bladder. In one configuration, the first container 34 can be a bladder that is provided within the recovery container 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 38 can comprise a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery container 20 where the fluid debris is substantially separated from the working air. The airstream then passes through the suction source 20 prior to being exhausted from the extraction cleaner 10. The recovery container 20 can be periodically emptied of collected fluid and debris.

During operation, hair, fuzz, carpet fibers or other material may become clogged within the suction nozzle 16 or stuck/intertwined on the agitator 26. The present invention provides a cleanout tool which can be used to effectively cleanout or remove hair, fuzz, carpet fibers, etc. from the suction nozzle 16 and the agitator 26 and restore optimum performance to the system.

Figure 2:
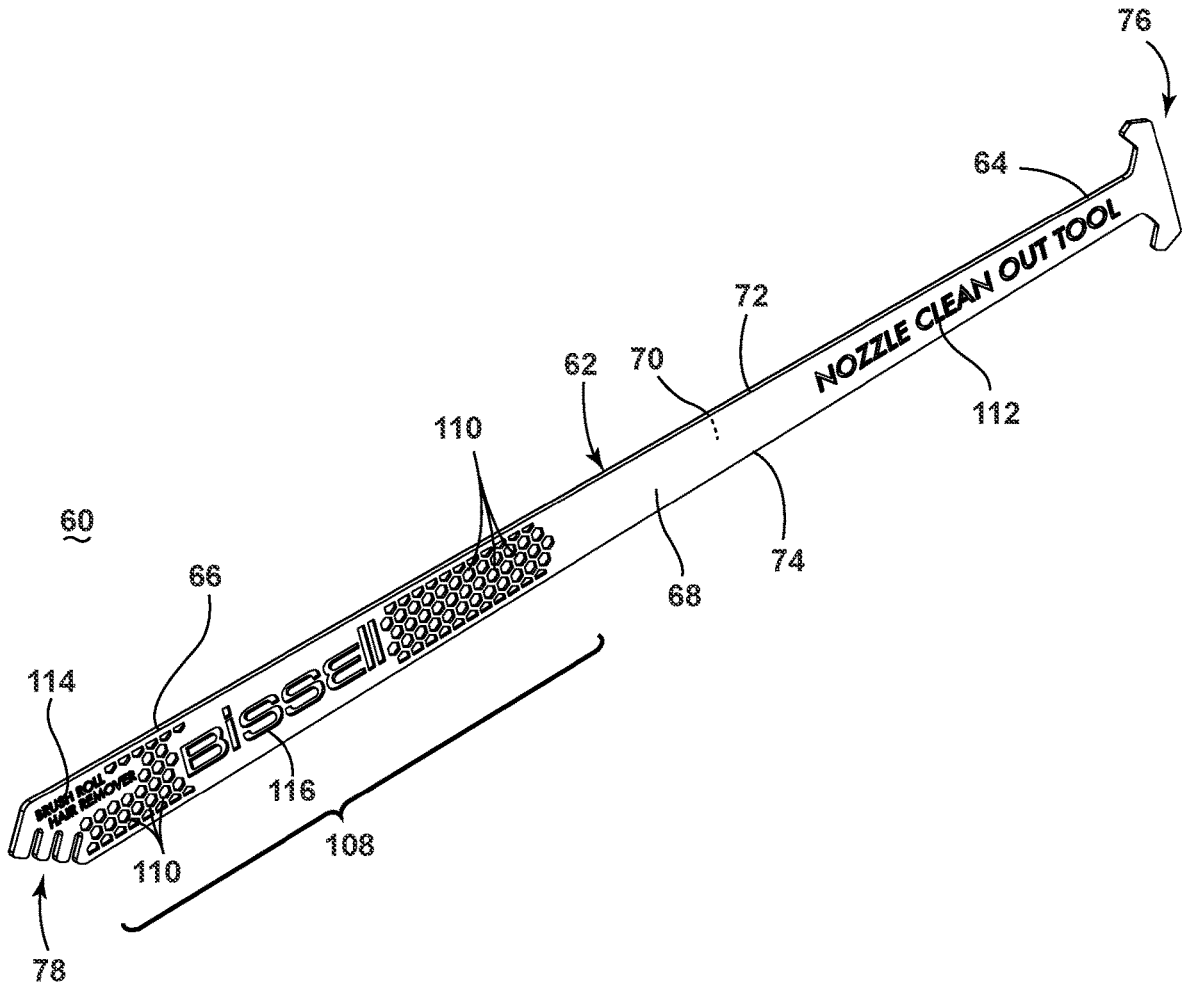
FIG. 2 is a perspective view of a cleanout tool for the extraction cleaner of FIG. 1 according to one embodiment of the invention.

FIG. 2 is a perspective view of a cleanout tool 60 for the extraction cleaner of FIG. 1 according to one embodiment of the invention. The cleanout tool 60 includes an elongated, flexible body 62 with opposing ends 64, 66. The body 62 can be flat or planar and generally rectilinear in shape, with opposing broad sides 68, 70 and opposing narrow sides or edges 72, 74 which join the broad sides 68, 70. Other embodiments of the invention may include a cleanout tool with a non-flat or non-rectilinear body. One end 64 of the body 62 can include a nozzle cleaning implement 76 and the opposite end 66 can include a brush cleaning implement 78.

In the illustrated embodiment, the body 62 can be thin, with the broad sides 68, 70 defining a width than is significantly greater than the thickness defined by the narrow sides or edges 72, 74. Regardless of the proportions of the tool 60, the thickness of the tool 60 may not exceed the smallest dimension of the suction nozzle 16 in order to fit within the suction nozzle 16. The thickness defined by the opposing edges 72, 74 may remain substantially constant along the length of the body 62, while the width defined by the broad sides 68, 70 may vary. For example, the body 62 may widen toward the brush cleaning implement 78. It is further noted that the length of the body 62 is significantly greater than the width of the broad sides 68, 70. The length of the body 62 allows the nozzle cleaning implement 76 to reach up into the nozzle of an extraction cleaner, as described in greater detail below.

The cleanout tool 60 can be formed of a flexible material which allows it to bend and flex as needed to traverse a non-linear path, such as those commonly found in extraction cleaner nozzles and agitator chambers, but return to substantially its original straight shape when not in use. In one example, the cleanout tool 60 may bend and flex relative to a plane parallel to the broad sides 68, 70 rather than the edges 72, 74, as needed to traverse an extraction cleaner nozzle, as described in greater detail below. In one example, the body 62 is a molded article, with the nozzle cleaning implement 76 and the brush cleaning implement 78 integrally molded with the body 62 from a common polymeric material. Some non-limiting examples of materials for the cleanout tool 60 include polypropylene and polyethylene. These materials also provide the cleanout tool 60 with chemical resistance.

Figure 3:
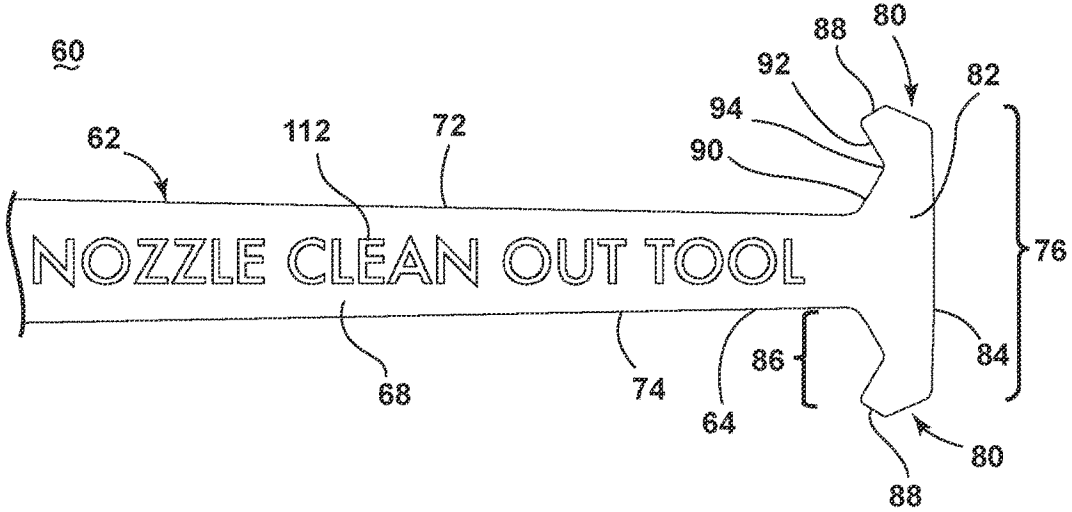
FIG. 3 is a top view of a portion of the cleanout tool from FIG. 2, showing a nozzle cleaning implement of the tool.

FIG. 3 is a top view of a portion of the cleanout tool 60 from FIG. 2, showing the nozzle cleaning implement 76. The illustrated nozzle cleaning implement 76 includes at least one hook 80 for catching debris or other clogged material in an extraction cleaner nozzle. In the illustrated embodiment the nozzle cleaning implement 76 includes a transversely-extending cross member 82 defining a flat edge 84 on the end of the body 62, with the cross member 82 having two opposing hooks 80 that project laterally. Each hook 80 includes an inner hooked edge 86 and an outer edge 88 that meets the flat edge 84. The inner hooked edge 86 meets the edges 72, 74 of the body 62. The broad side 68 of the body 62 can taper toward the nozzle cleaning implement 76 and meet the inner hook edge 86, which widens outwardly.

The inner hooked edge 86 can be curved or made up of multiple linear segments having a generally hooked or bent shape as illustrated herein. The linear segments include a medial segment 90 extending from the edges 72, 74 and a lateral segment 92 extending to the outer edge 88 of the hook 80. The segments 90, 92 can interconnect at an angle 94 to form the hooked shape of the hooked edge 86. The angle 94 may be obtuse.

Figure 4:
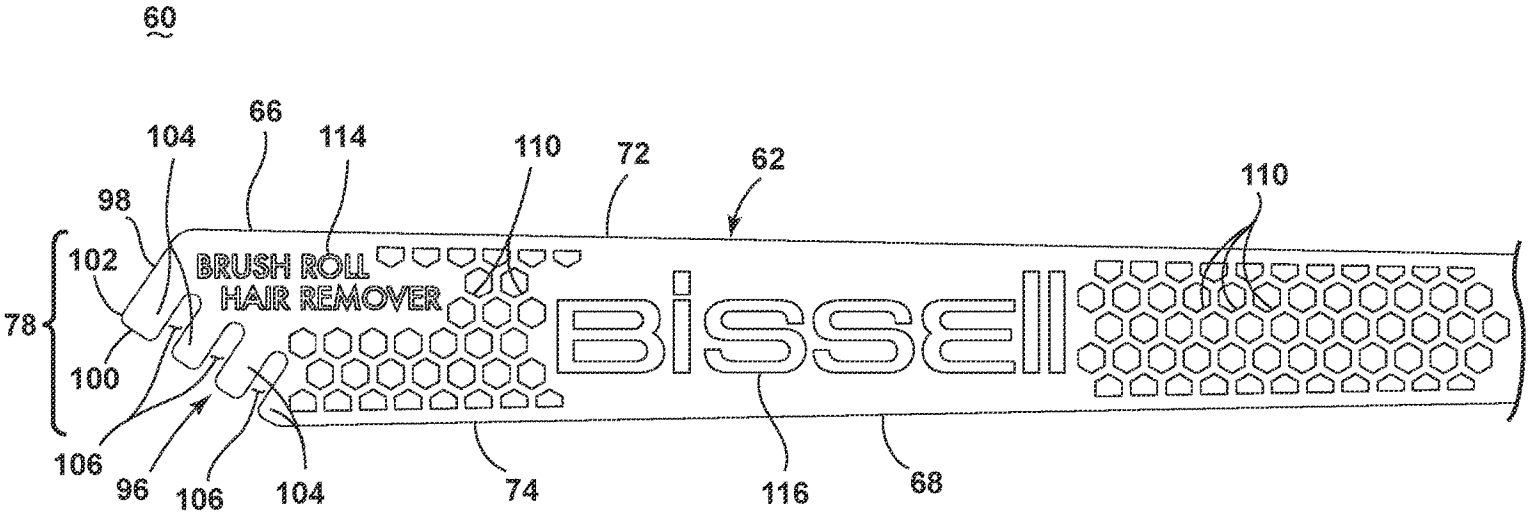
FIG. 4 is a top view of a portion of the cleanout tool from FIG. 2, showing a brush cleaning implement of the tool.

FIG. 4 is a top view of a portion of the cleanout tool 60 from FIG. 2, showing the brush cleaning implement 78. The illustrated brush cleaning implement 78 includes a comb 96 for removing debris or other material from an extraction cleaner agitator. The brush cleaning implement 78 can include two angled edges 98, 100 that extend from the edges 72, 74 of the body 62 and meet at a pointed end 102. The comb 96 can be provided on one of the angled edges 100. Disposing the comb 96 at an angle relative to the body 62 provides for a more ergonomic use of the brush cleaning implement 78. The comb 96 is provided with a set of tines 104 that define open-ended slots 106 therebetween. The tines 104 can have blunt ends which can define the angled edge 100.

Referring to FIG. 2, depending on which cleaning implement 76, 78 is in use, various portions of the body 62 can form a handle for the cleanout tool 60. For example, when the nozzle cleaning implement 76 is in use, the portions of the body 62 distal to the nozzle cleaning implement 76 can form the handle, including the central portion of the body 62 and the brush cleaning implement 78. When the brush cleaning implement 78 is in use, the portions of the body 62 distal to the brush cleaning implement 78 can form the handle, including the central portion of the body and the nozzle cleaning implement 76.

A gripping area 108 can be provided on the body 62 to aid the user in gripping the cleanout tool 60. The gripping area 108 can include gripping features, such as an array or grouping of raised or recessed features provided on at least one of the broad sides 68, 70. The gripping area 108 can run across the entire length of the body 62 or be provided on a smaller section of the body 62. In the illustrated embodiment, the gripping area 108 is on a portion of the body 62 closer to the brush cleaning implement 78. The gripping area 108 is further shown in the form of an array of recessed hexagons 110 on the first broad side 68 of the body 62.

Text 112, 114 can be provided on the cleanout tool 60 to indicate the function of each end 64, 66. The text 112 provided on the first end 64 can indicate to the user that the function of the first end 64 is to clean a nozzle. One non-limiting example of such text 112 is shown in FIG. 2 and reads "NOZZLE CLEAN OUT TOOL." The text 114 provided on the second end 66 can indicate to the user that the function of the second end 66 is to clean an agitator, such as but not limited to a brushroll. One non-limiting example of such text 114 is shown in FIG. 2 and reads "BRUSH ROLL HAIR REMOVER." A logo 116 of the tool provider can also be provided on the cleanout tool 60; as shown herein the logo 116 can be text reading "BISSELL." It is noted that the text 112, 114 and logo 116 on the cleanout tool 60 may be raised or recessed, and may form a gripping surface to aid the user in gripping the cleanout tool 60. In the embodiment illustrated herein, the logo 116 can lie within the array of recessed hexagons 110 and form a portion of the gripping area 108.

The gripping area 108, text 112, 114 and logo 116 are all shown herein as being provided on the same broad side 68 of the body 62. The opposite broad side 70 of the body 62 may be featureless, i.e. flat and without any grips or text or other ornamentation. Otherwise, similar grips and/or text may be provided on the opposite broad side 70 as well.

Figure 5:
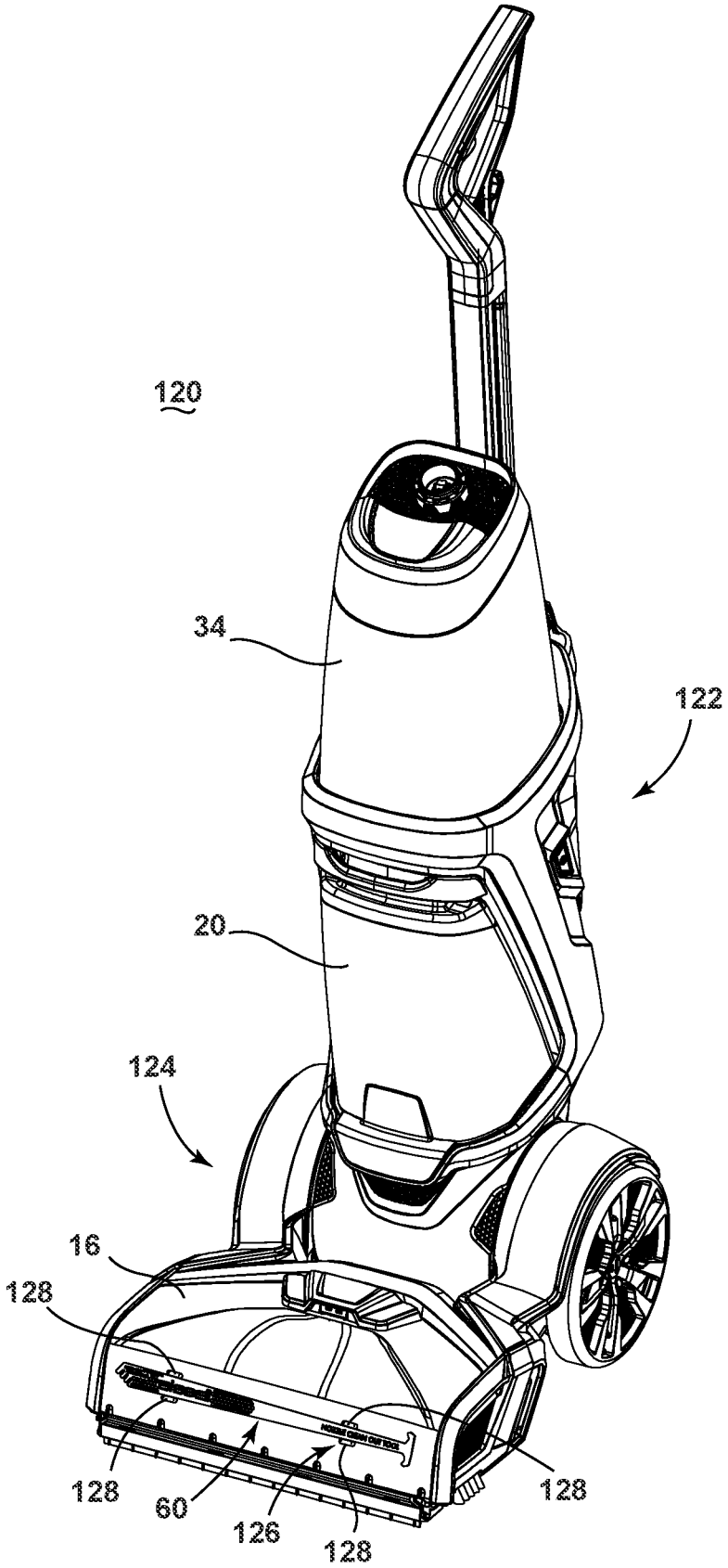
FIG. 5 is a perspective view of an extraction cleaner with a cleanout tool according to a second embodiment of the invention.

FIG. 5 is a perspective view illustrating the cleanout tool 60 stored on one non-limiting example of an extraction cleaner 120, according to a second embodiment of the invention. As illustrated herein, the extraction cleaner 120 is an upright extraction cleaner having a housing that includes an upright handle assembly 122 that is pivotally connected to a base assembly 124 for directing the base assembly 124 across the surface to be cleaned. The extraction cleaner 120 can comprise the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 124 and the handle assembly 122.

The extraction cleaner 120 can be configured to store the cleanout tool 60 when not in use. The extraction cleaner 120 can be provided with a tool mount 126 for mounting the cleanout tool 60 on a portion of the extraction cleaner 120. In the illustrated embodiment, the cleanout tool 60 is stored on the base assembly 124. More specifically, the base assembly 124 includes the suction nozzle 16, and the tool mount 126 is provided on the front of the suction nozzle 16. The tool mount 126 can include a plurality of detents 128 which releasably retain the cleanout tool 60 on the suction nozzle 16. To mount the cleanout tool 60 on the suction nozzle 16, the cleanout tool 60 can be pressed between the detents 128, which may flex about the cleanout tool 60 to secure it in place.

Figure 6:
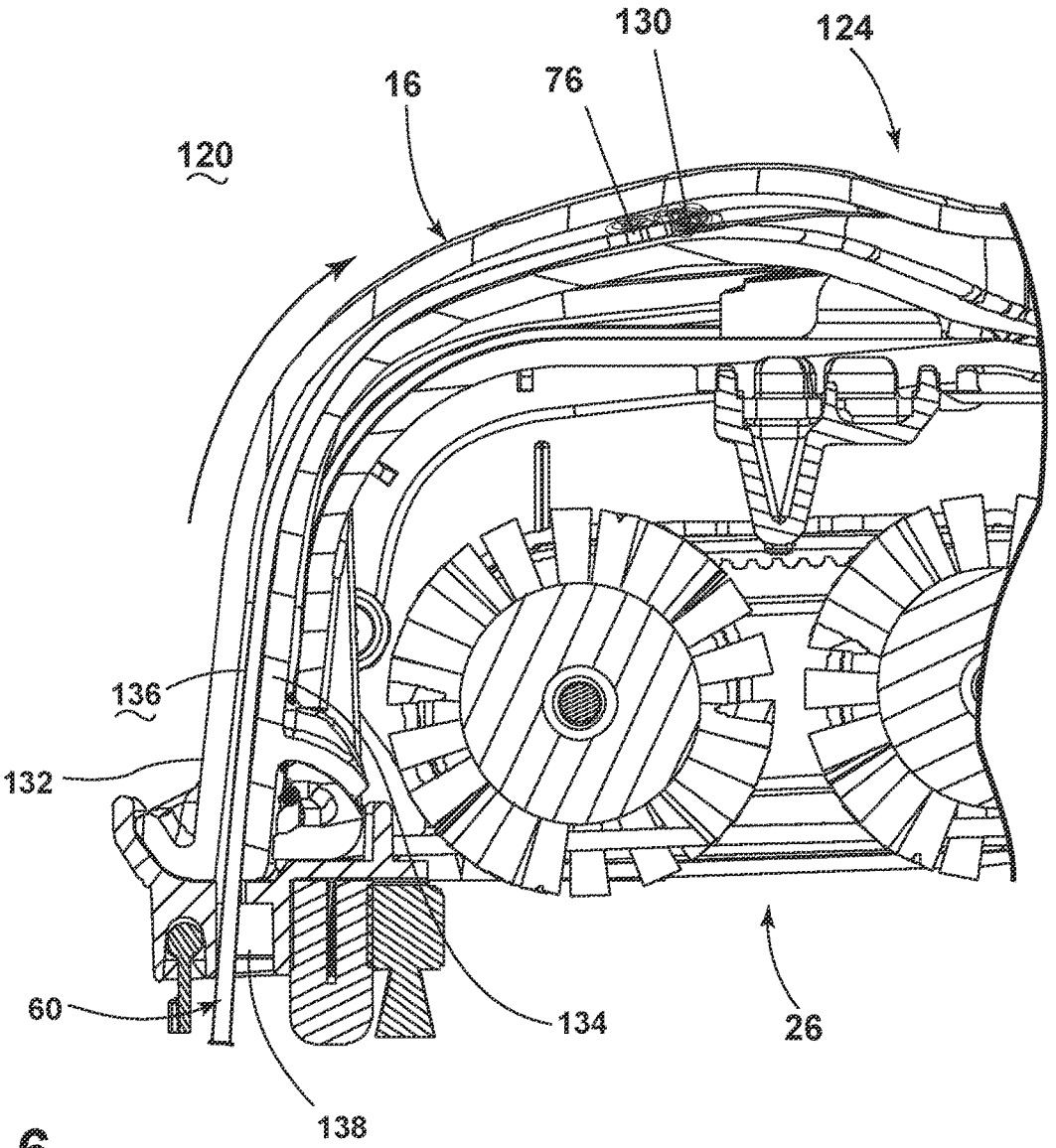
FIG. 6 is a section view through a suction nozzle of the extraction cleaner from FIG. 5 showing a method of using the cleanout tool to clean the suction nozzle.
Figure 7:
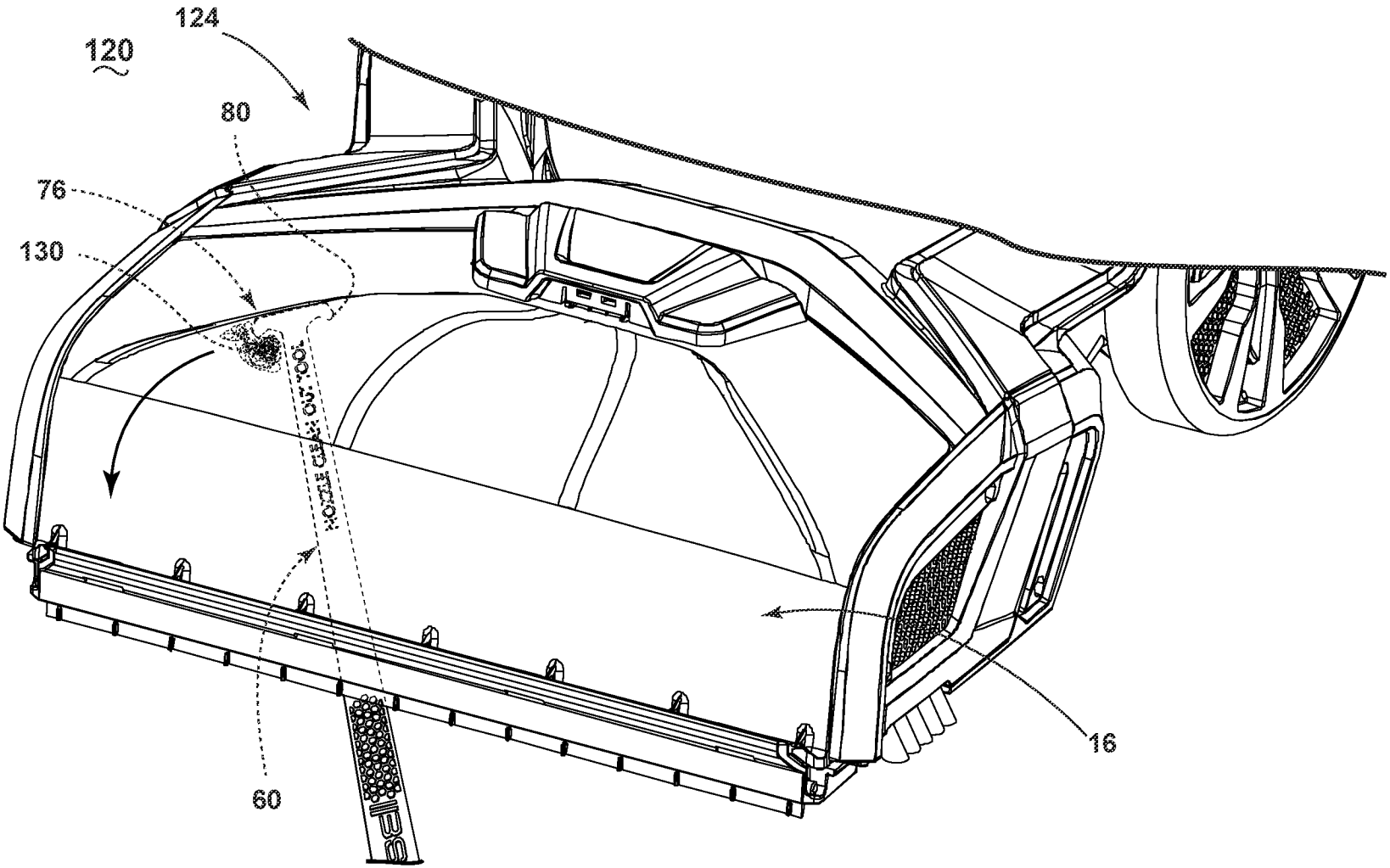
FIG. 7 is a perspective view of the extraction cleaner from FIG. 5 showing a method of using the cleanout tool to clean the suction nozzle.

FIGS. 6 and 7 illustrate a method of using the cleanout tool 60 to remove debris from the suction nozzle 16 of the extraction cleaner 120. The suction nozzle 16 of the extraction cleaner 120 is typically narrow, and may include a front wall 132 and a rear wall 134 defining a narrow suction pathway 136 therebetween with an opening 138 adjacent the surface to be cleaned. The walls 132, 134 may further be curved to define a curved pathway 136. During a cleaning operation, debris 130 may become lodged or stuck in the pathway 136, rather than being ingested into the recovery container 20 (FIG. 5). A user may become aware of the clogged debris 130 by reduced suction force at the opening 138 or may be able to see such debris 130 through the front wall 132 if it is made from a transparent material.

To clean out the debris 130, a user grips the cleanout tool 60 and inserts the nozzle cleaning implement 76 into the suction nozzle 16. The flexible tool 60 can traverse the pathway 136 to reach the debris 130 and the hooks 80 grip debris 130, with the debris 130 being removed from the suction nozzle 16 as the cleanout tool 60 is removed from the suction nozzle 16. The cleanout tool 60 may be moved laterally in a wiping motion to ensure the entire pathway 136 is cleared of debris. The provision of the opposing hooks 80 allow the cleanout tool 60 to be wiped in either direction as needed.

Figure 8:
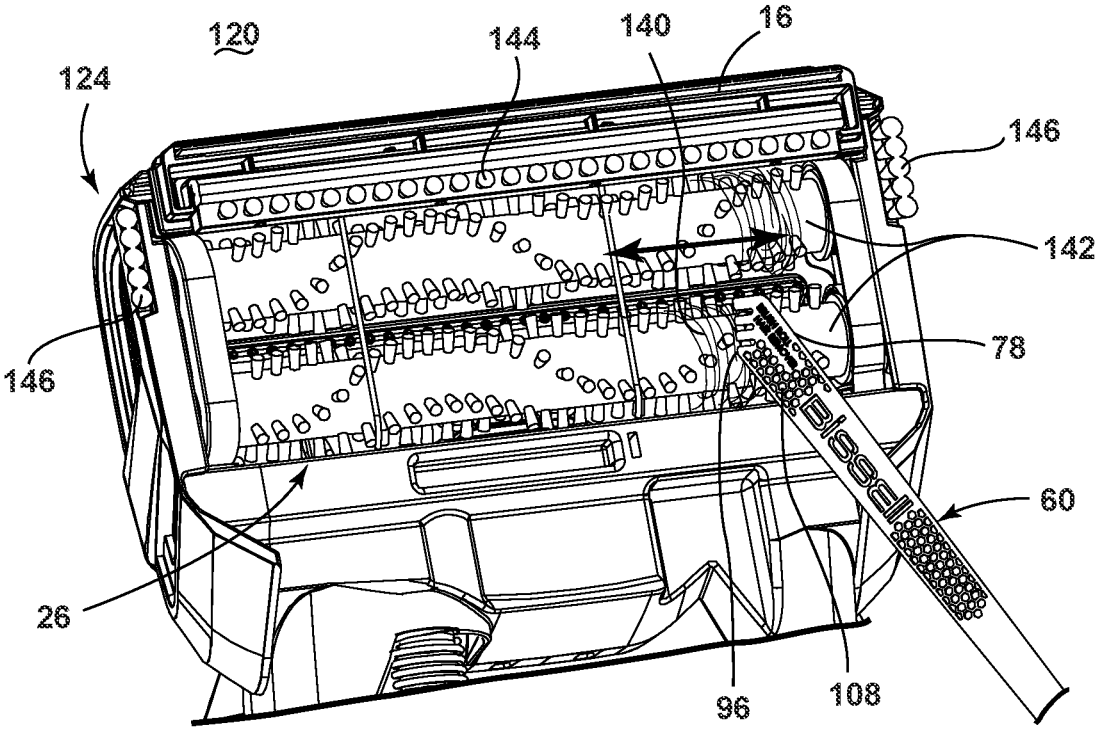
FIGS. 8-9 are bottom perspective views of the extraction cleaner from FIG. 5 showing a method of using the cleanout tool to clean an agitator of the extraction cleaner.
Figure 9:
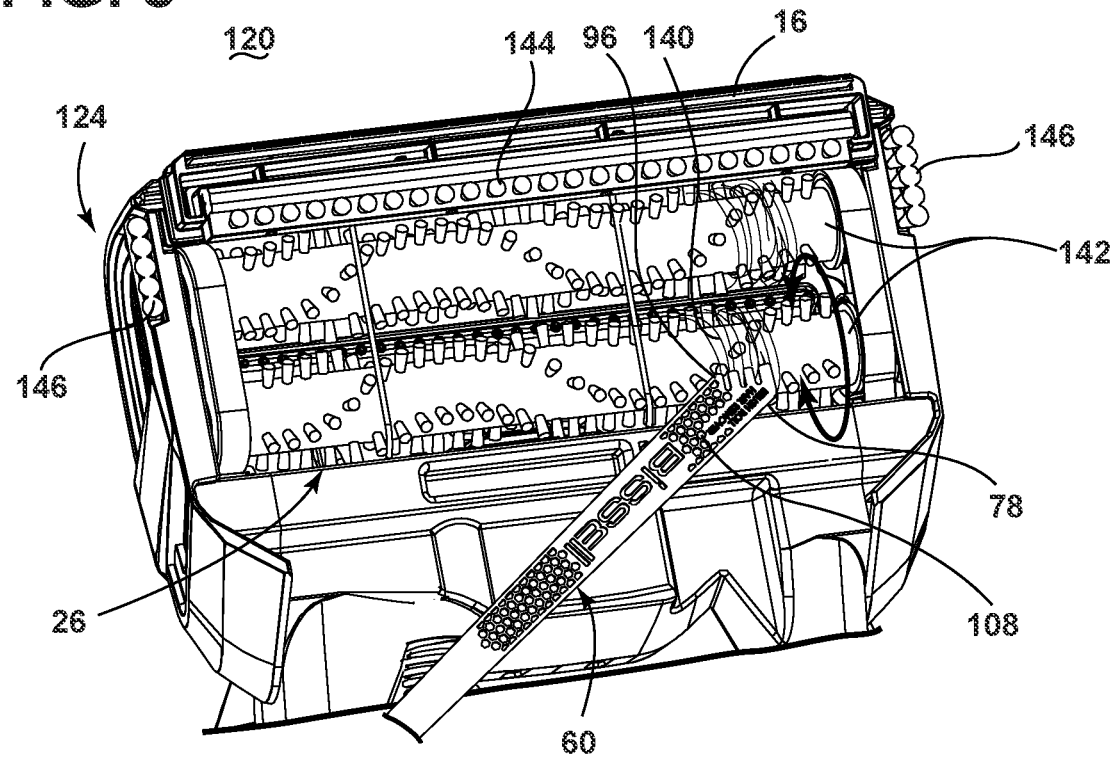

FIGS. 8 and 9 illustrate a method of using the cleanout tool 60 to remove debris, shown herein as hair 140 from the agitator 26 of the extraction cleaner 120. The agitator 26 of the extraction cleaner 120 includes dual horizontally-rotating brushrolls 142. A non-rotating brush strip 144 and edge brushes 146 are also provided. During a cleaning operation, hair 140 may become wrapped or intertwined on the rotating brushrolls 142, rather than being ingested into the suction nozzle 16. A user may become aware of the wrapped hair 140 by turning over the extraction cleaner 120 and looking at the underside of the base assembly 124.

To clean the hair 140 off the brushroll 142, with the extraction cleaner 120 tipped back to laid on its side to access the brushrolls 142, a user grips the cleanout tool 60, such as at the gripping area 108, and runs the brush cleaning implement 78 over the brushroll 142. The angled comb 96 serves to grip hair 140 on the brushroll 142, with the hair being removed from the brushroll 142 as the cleanout tool 60 is moved laterally across the length of the brushroll 142 (FIG. 8), and around the circumference of the brushroll 142 (FIG. 9, and/or in a combination of lateral and circumferential strokes to release the hair 140 from the bristles of the brushroll 142. The angled comb 96 allows the user to hold the cleanout tool 60 at an angle so that the user's hand is positioned above and does not contact the brushroll 142. The cleanout tool 60 can also be used to remove debris or hair from the brush strip 144 or edge brushes 146.

Figure 10:
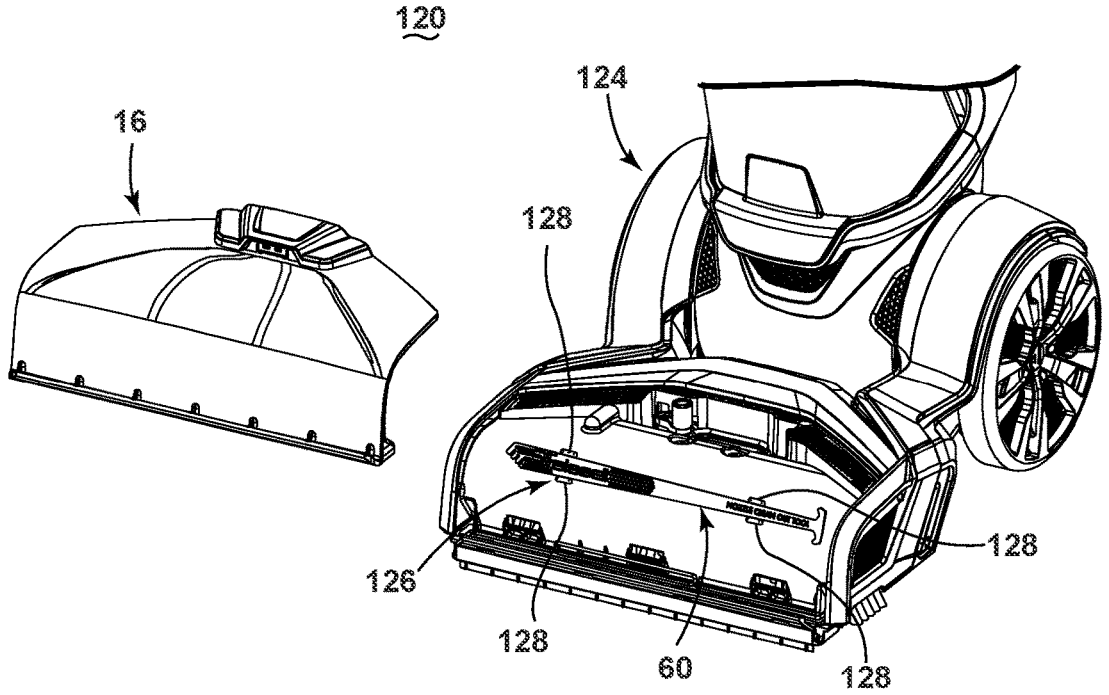
FIG. 10 is a partial exploded view of the extraction cleaner of FIG. 5, illustrating an alternative storage location for the cleanout tool on the extraction cleaner.

FIG. 10 is a partial exploded view of the extraction cleaner 120 of FIG. 5, illustrating an alternative storage location for the cleanout tool 60 on the extraction cleaner 120. In this embodiment, the suction nozzle 16 is removable from the base assembly 124 and the tool mount 126 is provided on an inner surface of the base assembly 124 in order to store the cleanout tool 60 in a concealed or hidden location.

Figure 11:
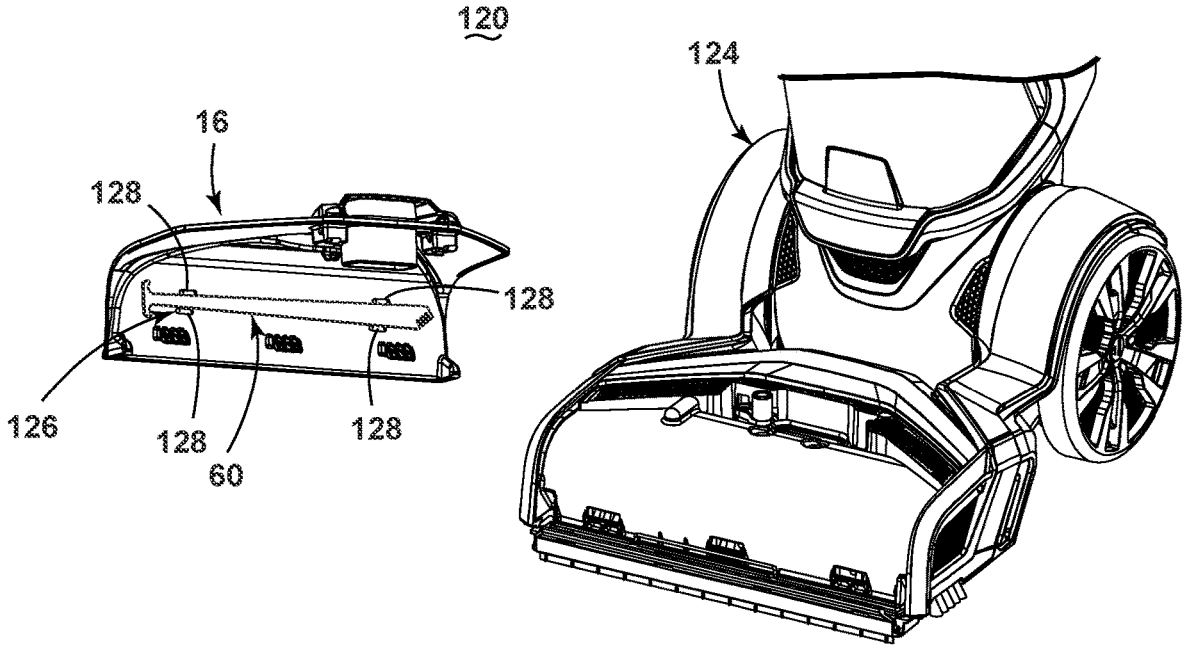
FIG. 11 is a partial exploded view of the extraction cleaner of FIG. 5, illustrating yet another alternative storage location for the cleanout tool on the extraction cleaner.

FIG. 11 is a partial exploded view of the extraction cleaner 120 of FIG. 4, illustrating yet another alternative storage location for the cleanout tool 60 on the extraction cleaner 120. In this embodiment, the suction nozzle 16 is removable from the base assembly 124 and the tool mount 126 is provided on an inner surface of the suction nozzle 16 in order to store the cleanout tool 60 in a concealed or hidden location.

While the various embodiments illustrated herein show the cleanout tool 60 being stored on the base assembly 124 of the extraction cleaner 120, in other embodiments of the invention the cleanout tool 60 can be stored on other portions of the extraction cleaner 120, such as on the upright handle assembly 122 (FIG. 4) or anywhere on the extraction cleaner 120. The cleanout tool 60 may also be stored anywhere on and used to clean other types of extraction cleaners, including, but not limited to, a canister device having a cleaning implement connected to a wheeled base by a vacuum hose, a portable extractor adapted to be hand carried by a user for cleaning relatively small areas, or a commercial extractor.

Further, while the various embodiments illustrated herein show the cleanout tool 60 being used with an extraction cleaner 10, the cleanout tool 60 may also be used to clean the suction nozzle or agitator of a vacuum cleaner. As used in the art, a vacuum cleaner typically does not deliver or extract liquid, but rather is used for collecting relatively dry debris (which may include dirt, dust, stains, soil, hair, and other debris) from a surface. The cleanout tool 60 can be configured to remove hair, fuzz, carpet fibers or any other material that may become stuck/intertwined on the agitator of the vacuum cleaner. In typical vacuum cleaners, the agitator is placed at or within the suction nozzle, and is therefore relatively wide in comparison to the suction nozzle of an extraction cleaner; as such the suction nozzle of a vacuum cleaner may not be as difficult to clean as the suction nozzle of an extraction cleaner. However, the cleanout tool 60 may still be helpful in removing hair, fuzz, carpet fibers or any other material that may become clogged within the suction nozzle of a vacuum cleaner. As with the extraction cleaner, the cleanout tool 60 can be stored anywhere on the vacuum cleaner.

The cleanout tool 60 disclosed herein provides a multi-function tool that improves cleaning and maintenance of surface cleaning apparatuses, such as extraction cleaners and vacuum cleaners. One advantage that may be realized in the practice of some embodiments of the described cleanout tool 60 is that debris can be effectively removed from the suction nozzle of an extraction cleaner. The nozzles on extraction cleaners are typically narrow, and debris ingested into the cleaner may become stuck in the suction nozzle rather than taken into the recovery container. These suction nozzles are historically difficult to clean out because of the narrow suction pathway. Previous attempts to clean the suction nozzle have required the user to disassemble the suction nozzle, which is time consuming and messy. The cleanout tool 60 provides a device for removing clogged debris from the pathway without having to disassembly the suction nozzle.

Another advantage that may be realized in the practice of some embodiments of the described cleanout tool 60 is that hair and other debris can be effectively removed from agitators as well. Brushrolls typically have a generally cylindrical dowel with multiple bristles extending radially from the dowel. In operation, debris on a surface to be cleaned is loosened by the brushroll for ingestion through the suction nozzle; in some cases, elongated debris such as hair may become wrapped around the brushroll. Typically, hair must be removed by a user by manually pulling or cutting the hair off the brushroll. The cleanout tool 60 provides a device for removing hair without having to directly touch the brushroll, which is often dirty and/or wet after use.

Yet another advantage that may be realized in the practice of some embodiments of the described cleanout tool 60 is that a single tool has been provided for performing multiple commonplace maintenance functions for a surface cleaning apparatus. The cleanout tool 60 is provided with opposing ends, each adapted for performing one maintenance function: nozzle cleaning or agitator cleaning.

The disclosed embodiments are representative of preferred forms of the invention and are intended to be illustrative rather than definitive of the invention. To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Reasonable variation and modification are possible within the forgoing disclosure and drawings without departing from the scope of the invention which is defined by the appended claims.

What is claimed is:

1. A surface cleaning apparatus, comprising:

a fluid delivery system, comprising:

at least one fluid container for storing a supply of fluid; and a fluid distributor in fluid communication with the at least one fluid container for delivering fluid to a surface to be cleaned;

a recovery system, comprising:

a suction nozzle assembly defining a suction pathway;

a suction source in fluid communication with the suction pathway for generating a working air stream; and a recovery container for collecting fluid and debris from the working air stream for later disposal;

an agitator;

a housing, wherein the suction nozzle assembly is removable from the housing; and a tool mount adapted to provide storage onboard for a cleanout tool adapted to clean at least one of the agitator or a portion of the recovery system of the surface cleaning apparatus, wherein the tool mount is provided on an inner surface of the housing behind the suction nozzle assembly.

2. The surface cleaning apparatus of claim 1 wherein the agitator is provided adjacent the suction nozzle.

3. The surface cleaning apparatus of claim 1 wherein the cleanout tool comprises an elongated body having a first end and a second end opposite the first end.

4. The surface cleaning apparatus of claim 3 wherein the first end includes at least one hook.

5. The surface cleaning apparatus of claim 4 wherein the second end includes a comb having a plurality of tines, and wherein the plurality of tines has ends which define an angled edge of the second end.

6. The surface cleaning apparatus of claim 5 wherein the comb is disposed at an angle relative to the elongated body.

7. The surface cleaning apparatus of claim 5 wherein the at least one hook and the plurality of tines lie in a common plane.

8. The surface cleaning apparatus of claim 3 wherein the elongated body is formed of a flexible polymeric material which allows the elongated body to bend during use and return to a straight shape after use.

9. The surface cleaning apparatus of claim 8 wherein the elongated body is a flat rectangular shape.

10. The surface cleaning apparatus of claim 9 wherein the elongated body includes two opposing sides and joined with two opposing edges which are narrower than a width defined by the sides, and wherein the elongated body comprises a length defined between the first and second ends, and the length is greater than the width defined by the sides.

11. The surface cleaning apparatus of claim 3 wherein the first end of the elongated body comprises two opposing hooks.

12. The surface cleaning apparatus of claim 1 wherein the housing further comprises a base assembly and the tool mount is provided on a portion of the base assembly.

13. The surface cleaning apparatus of claim 1 wherein the tool mount comprises a plurality of detents extending from the housing.

14. The surface cleaning apparatus of claim 1 wherein at least a portion of the suction nozzle assembly is transparent.

15. The surface cleaning apparatus of claim 1 wherein the tool mount comprises a plurality of detents.

16. A surface cleaning apparatus, comprising:

a fluid delivery system, comprising:

at least one fluid container for storing a supply of fluid; and a fluid distributor in fluid communication with the at least one fluid container for delivering fluid to a surface to be cleaned;

a recovery system, comprising:

a suction nozzle assembly defining a suction pathway;

a suction source in fluid communication with the suction pathway for generating a working air stream; and a recovery container for collecting fluid and debris from the working air stream for later disposal;

an agitator;

a housing, wherein the suction nozzle assembly is removable from the housing; and a tool mount adapted to provide storage onboard for a cleanout tool adapted to clean at least one of the agitator or a portion of the recovery system of the surface cleaning apparatus, wherein the tool mount is located on a front surface of the suction nozzle assembly.

17. A surface cleaning apparatus, comprising:

a fluid delivery system, comprising:

at least one fluid container for storing a supply of fluid; and a fluid distributor in fluid communication with the at least one fluid container for delivering fluid to a surface to be cleaned;

a recovery system, comprising:

a suction nozzle assembly defining a suction pathway;

a suction source in fluid communication with the suction pathway for generating a working air stream; and a recovery container for collecting fluid and debris from the working air stream for later disposal;

an agitator;

a housing, wherein the suction nozzle assembly is removable from the housing; and a tool mount adapted to provide storage onboard for a cleanout tool adapted to clean at least one of the agitator or a portion of the recovery system of the surface cleaning apparatus, wherein the tool mount is located on an inner surface of the suction nozzle assembly.

* * * * *